US005802621A

United States Patent [19]

Chou

[11] Patent Number: 5,802,621

[45] Date of Patent: Sep. 8, 1998

[54] SWIMMING GOGGLES WITH IMPROVED WATER-PROOF EFFECT

[76] Inventor: Terry Chou, No. 12, Hsin Ho Herng Rd., Tainan City, Taiwan

[21] Appl. No.: 963,348

[22] Filed: Nov. 3, 1997

[51] Int. Cl.[6] ..... A61F 9/02

[52] U.S. Cl. ..... 2/430; 2/439; 2/440; 2/445

[58] Field of Search ..... 2/428, 430, 445, 2/452, 446, 440, 441, 442, 443, 426, 431, 447; 351/43

[56] References Cited

U.S. PATENT DOCUMENTS

| | | | |
|---|---|---|---|
| 5,524,300 | 6/1996 | Chiang | 2/439 |
| 5,546,611 | 8/1996 | Lathrop | 2/428 |
| 5,706,527 | 1/1998 | Kita et al. | 2/452 |

*Primary Examiner*—Peter Nerbun

*Attorney, Agent, or Firm*—Charles E. Baxley, Esq.

[57] ABSTRACT

A pair of swimming goggles includes two lenses formed of transparent rigid material, a goggle frame for receiving the lenses, and a length-adjustable strap having two ends attached to one of the goggle frame and the lenses. Each lens includes a peripheral surface formed therearound and extended inwardly to provide an increased visual angle, and a flange is formed around the peripheral surface. Each lens further includes a rigid engaging section having a hook formed thereon. The goggle frame is integrally formed of plastic material and includes two rings interconnected by a connecting section. Each ring includes an annular groove defined in an annular periphery thereof for receiving the flange of an associated lens. Each ring further includes an protective wall for close contact with an eye socket. The connecting section includes two engaging recesses for respectively, securely receiving the hooks on the lenses.

1 Claim, 8 Drawing Sheets

SWIMMING GOGGLES WITH IMPROVED WATER-PROOF EFFECT

BACKGROUND OF THE INVENTION

1. Field of the Invention

The present invention relates to a pair of swimming goggles with improved water-proof effect.

2. Description of the Related Art

FIG. 6 of the drawings illustrates a pair of typical swimming goggles which includes two lenses 51, a pad means 52 mounted to each lens 51, and an elastic strap 54. Each pad means 52 includes an inner peripheral groove 521 for receiving the associated lens 51 and a protective wall 522 for close contact with an eye socket. The strap 54 includes a buckle 55 provided to each of two ends thereof for allowing adjustment of a length thereof. Each lens 51 includes a transparent peripheral surface 511 formed therearound and extended inwardly to provide an increased visual angle. In addition, each lens 51 includes a first engaging piece 514 formed on a first side thereof which is distal to the other lens 51, in which the first engaging piece 514 includes a first opening (not labeled) through which an associated end of the strap 54 extends. Each lens 51 further includes a second engaging piece 513 formed on a second side thereof which is adjacent to the other lens 51, in which the second engaging piece 513 includes a second opening (not labeled) defined therein, and a connecting member 53 is provided between the two second engaging pieces 513.

The connecting member 53 is substantially U-shaped and has a thickness slightly smaller than a width of the second opening 513. A length of the connecting member 53 is slightly greater than a distance between the two eye sockets of the user. The connecting member 53 includes an inner side having a number of spaced ridges 531 formed thereon for releasably engaging with the second openings 513. The connecting member 53 further includes a smooth outer side to prevent from scraping the user's face. In use, the connecting member 53 may extend too inwardly beyond the protective wall 522 and thus may cause injury to the user's face. In addition, the connecting member 53 may be disengaged from the second engaging pieces 513 as the contracting force of the strap 54 is often greater than the engaging force between the ridges 531 of the connecting member 53 and the second engaging pieces 513. Furthermore, there is a limitation to the width of the connecting member 7 since it must be engaged in the associated second openings, which cannot provide an aesthetic outline.

FIG. 7 illustrates another pair of prior art swimming goggles in which the lenses 61, the connecting piece 62, the frame 63 for receiving the lenses 61, and the pads 64 are integral and in which the last three elements are formed of same plastic material while the lenses 61 are formed of transparent rigid material. As shown in FIG. 8, each lens 61 includes a number of annularly disposed holes 611 defined in an outer peripheral edge thereof while the frame 63 having two rings each of which includes a lip 631. In manufacture, after placing the lenses 61 into a mold, plastic material is poured to directly form the frames 63, the connecting piece 62, and the pads 64. The holes 611 is filled with plastic material to secure the lenses 61 to the ring and to allow edges of the lenses 61 to be enclosed by the lips 631. As shown in FIG. 8, the connecting piece 62 is integral with the frames 63 and is made of plastic material such that when the user pulls the strap 65, especially in the water, the lips 631 may deform and thus cannot reliably enclose the lenses 61 such that leakage may be caused in the area "a".

In addition, the visual angle provided by this pair of swimming goggles is limited as the rings are not transparent.

The present invention is intended to provide an improved connecting device for swimming goggles which mitigates and/or obviates the above problems.

SUMMARY OF THE INVENTION

A pair of swimming goggles in accordance with the present invention includes two lenses formed of transparent rigid material, a goggle frame for receiving the lenses, and a length-adjustable strap having two ends attached to one of the goggle frame and the lenses. Each lens includes a peripheral surface formed therearound and extended inwardly to provide an increased visual angle, and a flange is formed around the peripheral surface. Each lens further includes a rigid engaging section having a hook formed thereon.

The goggle frame is integrally formed of plastic material and includes two rings interconnected by a connecting section. Each ring includes an annular groove defined in an annular periphery thereof for receiving the flange of an associated lens. Each ring further includes an protective wall for close contact with an eye socket. The connecting section includes two engaging recesses for respectively, securely receiving the hooks on the lenses.

When the user pulls the strap, although the connecting section deforms, the rings does not deform due to provision of the rigid engaging section to thereby maintain reliable close contact between the flanges and the annular grooves to thereby prevent from leakage.

Other objects, advantages, and novel features of the invention will become more apparent from the following detailed description when taken in conjunction with the accompanying drawings.

DESCRIPTION OF THE PREFERRED EMBODIMENT

Figure 1:
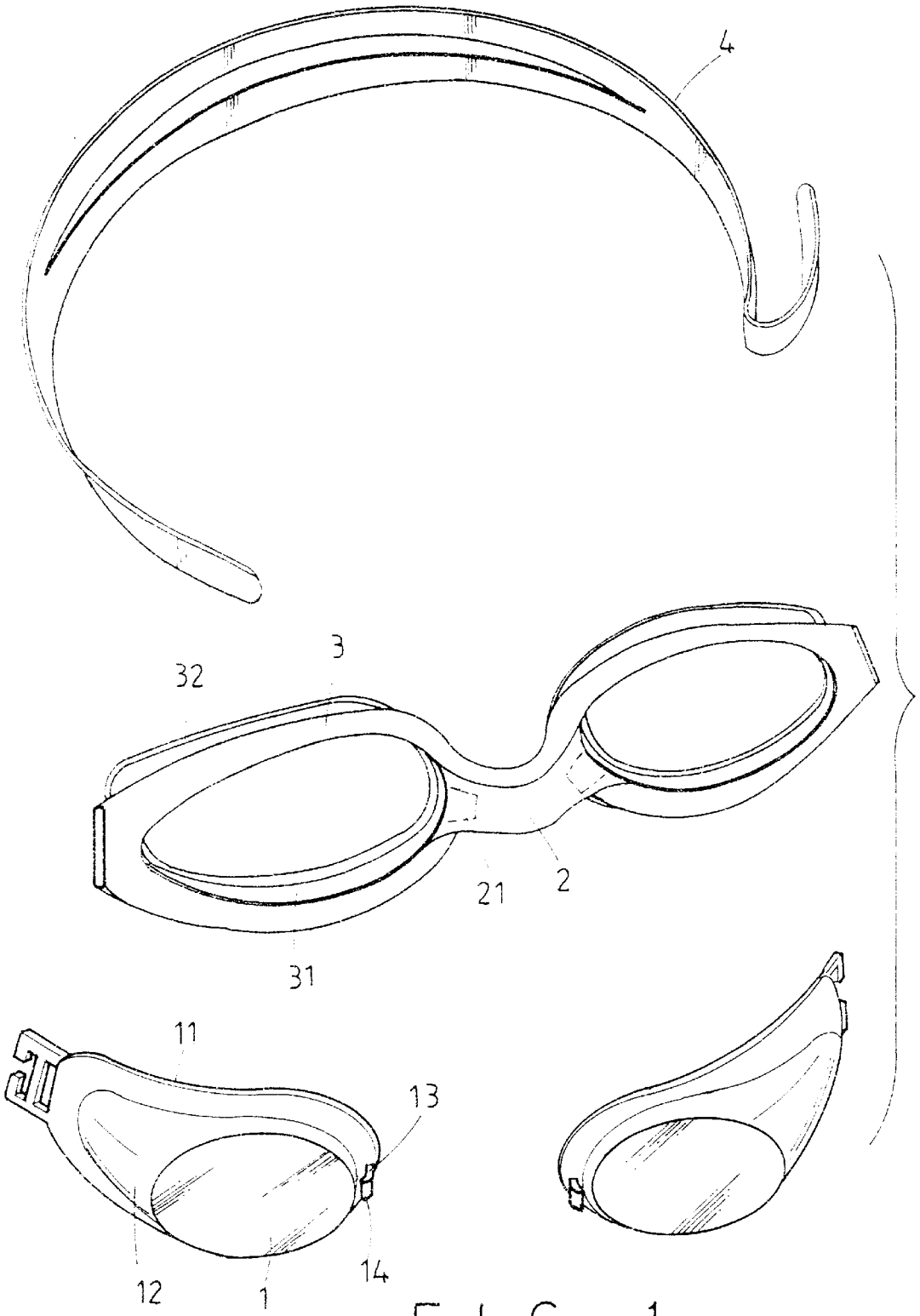
FIG. 1 is an exploded perspective view of a pair of swimming goggles in accordance with the present invention.
Figure 2:
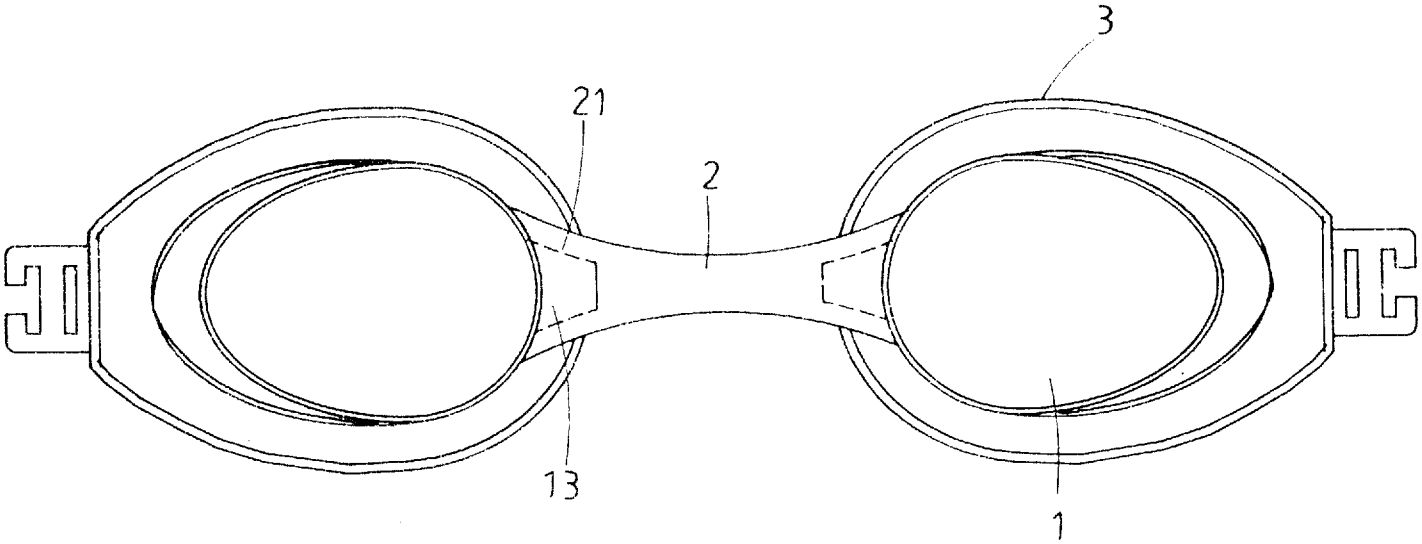
FIG. 2 is a front elevational view of the swimming goggles in accordance with the present invention.
Figure 3:
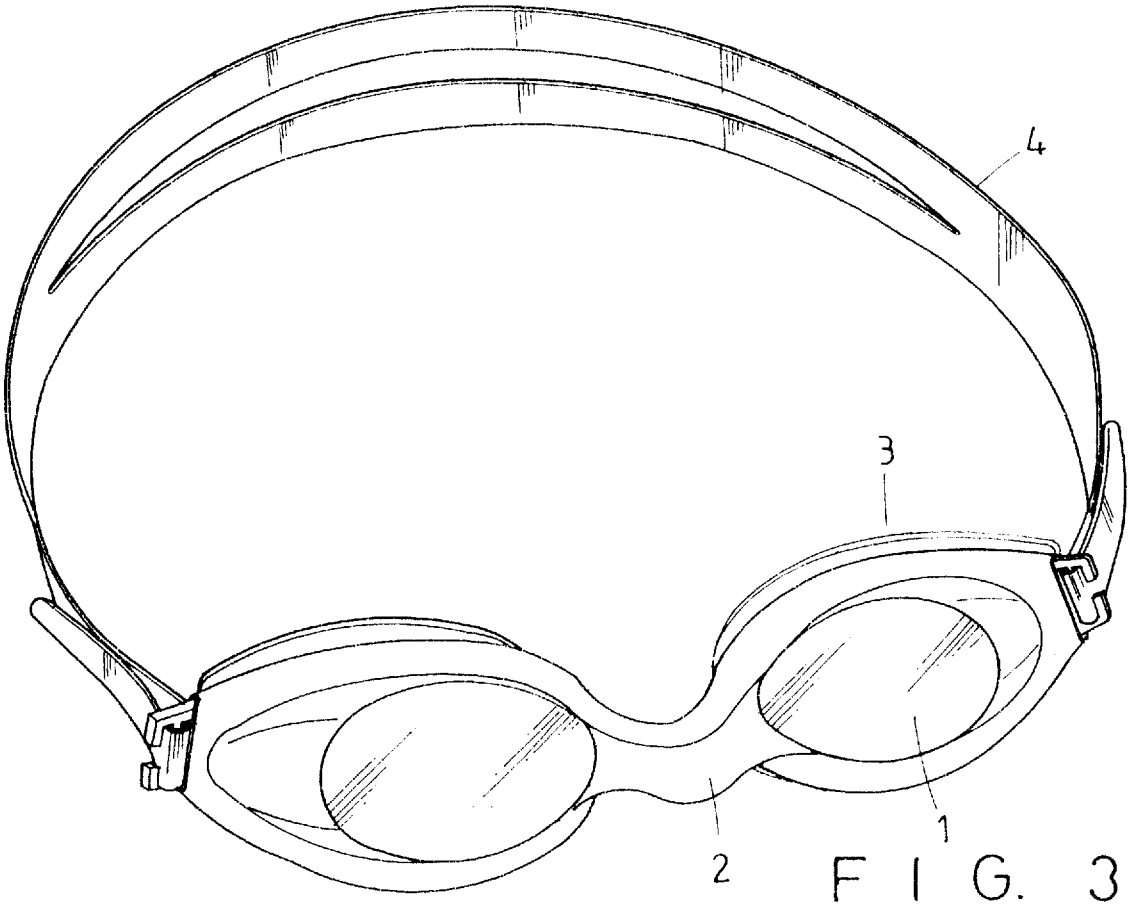
FIG. 3 is a perspective view of the swimming goggles in accordance with the present invention.
Figure 4:
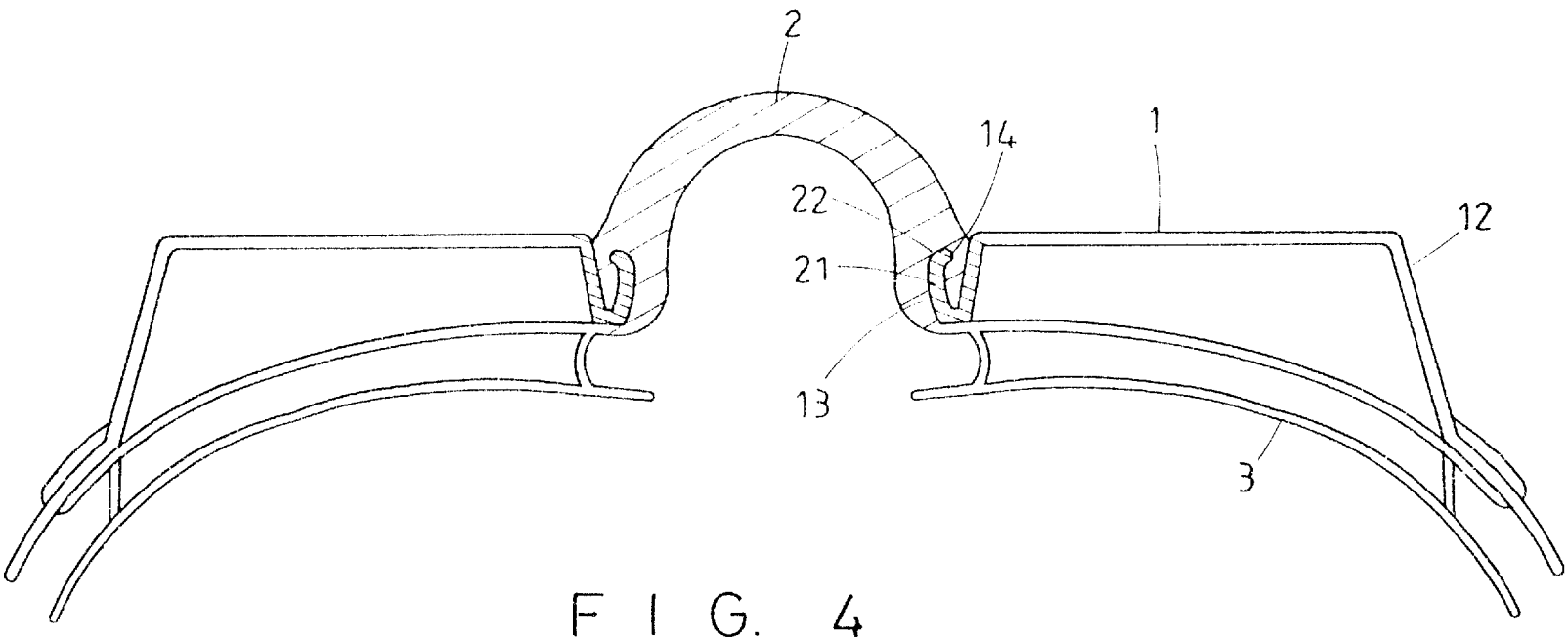
FIG. 4 is a top view, partly sectioned, illustrating a portion of the swimming goggles in accordance with the present invention.

Referring to FIGS. 1 to 5 and initially to FIGS. 1 and 3, a pair of swimming goggles generally comprises two lenses 1 formed of transparent rigid material, a goggle frame for receiving the lenses 1, and a length-adjustable strap 4 which connects outer sides of the lenses 1 or outer sides of the goggle frame. As shown in FIG. 1, each lens 1 includes a peripheral surface 12 formed therearound and extended inwardly to provide an increased visual angle, and a flange 11 is formed around the peripheral surface 12. In addition, each lens 1 includes a rigid engaging section 13 having a hook 14 formed thereon.

The goggle frame is integrally formed of plastic material and includes two rings 3 interconnected by a connecting section 2. Each ring 3 includes an annular groove 31 defined in an annular periphery thereof for receiving the flange 11 of the associated lens 1. Each ring 3 further includes an protective wall 32 for close contact with an eye socket. In addition, the connecting section 2 includes two engaging recesses 21 for respectively, securely receiving the hooks 14 on the lenses 1.

Figure 5:
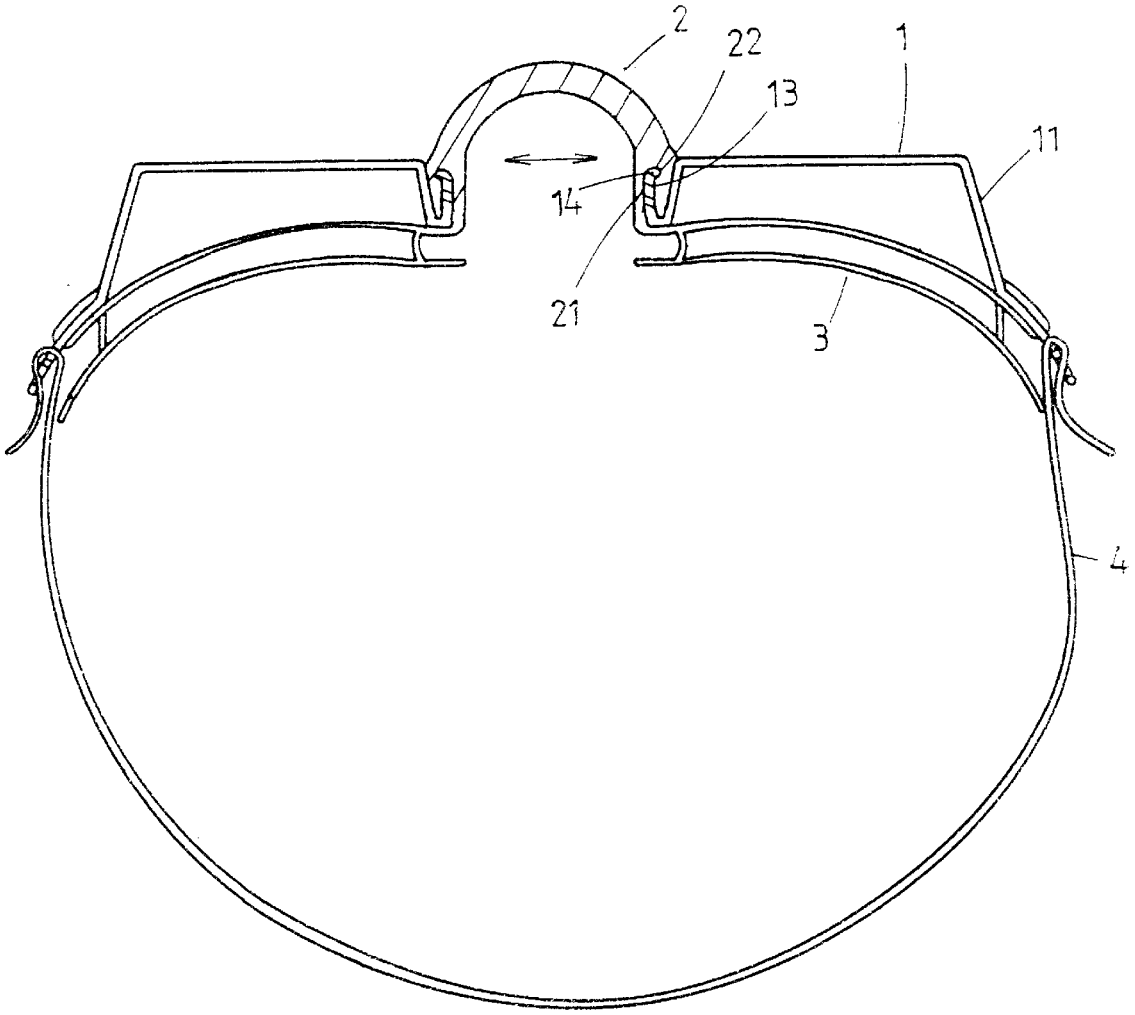
FIG. 5 is a top view, partly sectioned, illustrating use of the swimming goggles in accordance with the present invention.
Figure 6:
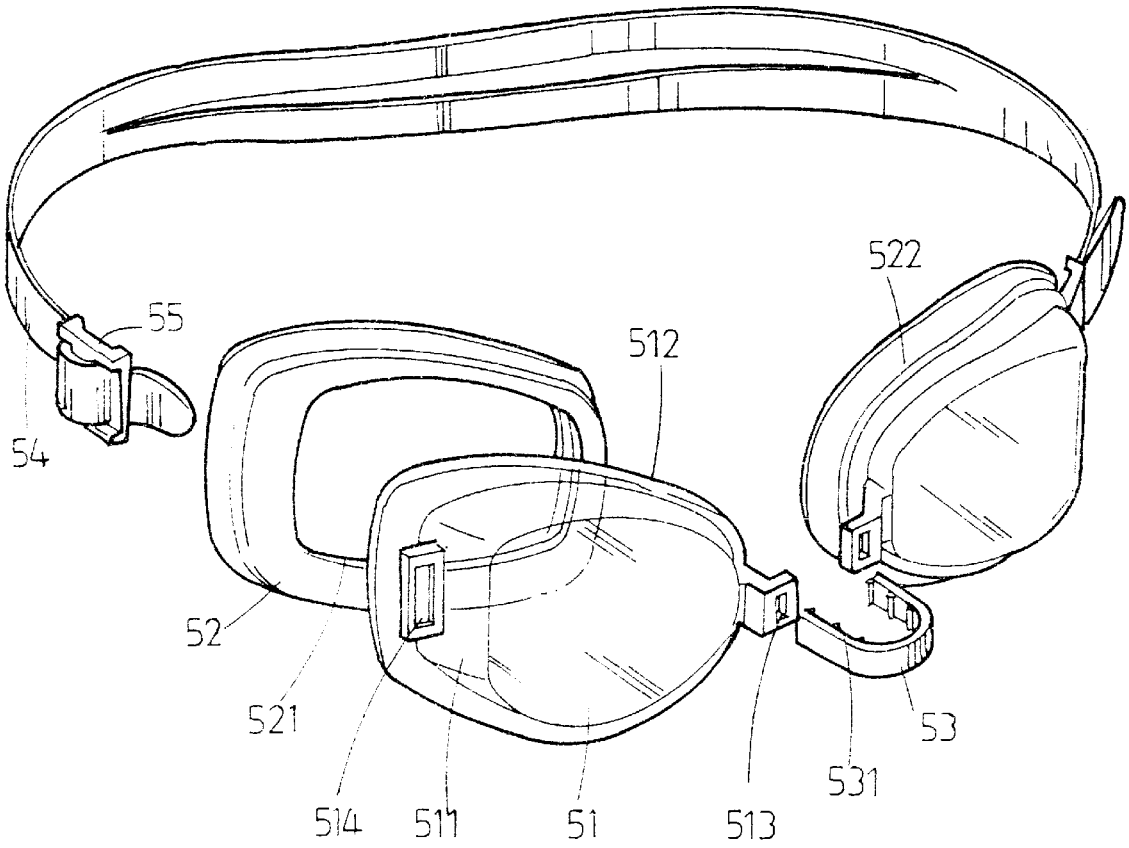
F I G. 6 PRIOR ART
FIG. 6 is a perspective view, partly exploded, of a pair of swimming goggles according to prior art.
Figure 7:
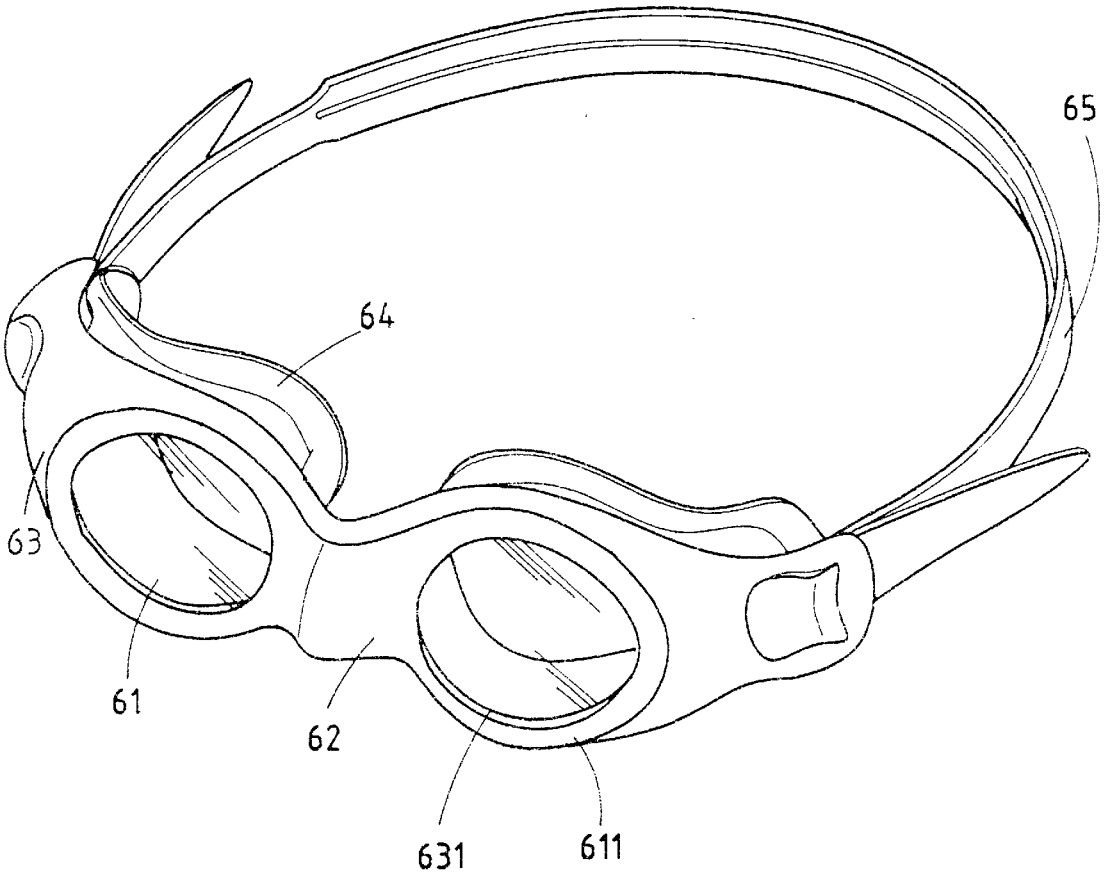
F I G. 7 PRIOR ART
FIG. 7 is a perspective view of another pair of swimming goggles according to prior art.
Figure 8:
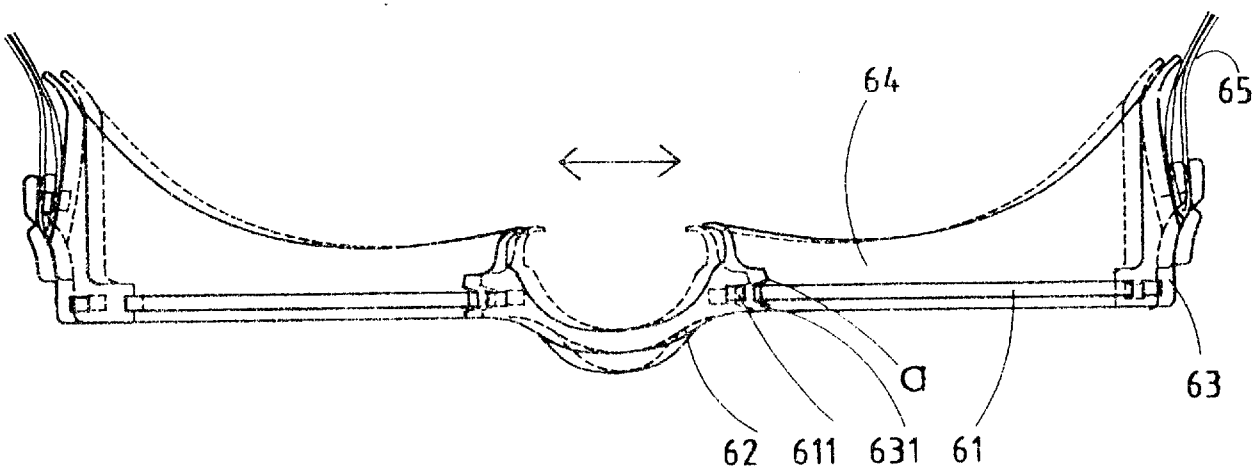
FIG. 8 PRIOR ART
FIG. 8 is a top view illustrating a portion of the prior art swimming goggles in FIG. 7.

In assembly, the lenses 1 are inserted into the rings 3 with the hooks 14 received in the engaging recesses 21 to provide an increased engaging effect. Referring to FIG. 5, when in use, and when the user pulls the strap 4, although the connecting section 2 deforms, the rings 3 does not deform due to provision of the rigid engaging section 13 to thereby maintain reliable close contact between the flanges 11 and the annular grooves 31 to thereby prevent from leakage.

According to the above description, it is appreciated that the present swimming goggles provides an increased visual angle while leakage between the lenses 1 and the frame 3 is avoided. In addition, only few elements are required to form the goggles without adversely affecting safety. Further, the connecting section provides a good-looking outline.

Although the invention has been explained in relation to its preferred embodiment, it is to be understood that many other possible modifications and variations can be made without departing from the spirit and scope of the invention as hereinafter claimed.

What is claimed is:

1. A pair of swimming goggles, comprising:

two lenses formed of transparent rigid material, each said lens including a peripheral surface formed therearound and extended inwardly to provide an increased visual angle, and a flange being formed around the peripheral surface, each said lens further including a rigid engaging section having a hook formed thereon, a goggle frame which is integrally formed of plastic material and includes two rings interconnected by a connecting section, each said ring including an annular groove defined in an annular periphery thereof for receiving the flange of an associated one of said lenses, each said ring further including a protective wall for close contact with an eye socket, the connecting section including two engaging recesses for respectively, securely receiving the hooks on the lenses, and a length-adjustable strap having two ends attached to one of the goggle frame and the lenses.

* * * * *